United States Patent [19]

Graham

[11] 4,085,548

[45] Apr. 25, 1978

[54] APPARATUS FOR MANUFACTURE OF INSULATION PRODUCTS

[75] Inventor: Robert Graham, Chester-le-Street, England

[73] Assignee: Newalls Insulation Company Limited, Manchester, England

[21] Appl. No.: 768,777

[22] Filed: Feb. 15, 1977

[30] Foreign Application Priority Data

Feb. 21, 1976 United Kingdom ..... 06899/76

[51] Int. Cl.[2] ..... B24B 5/32; B24B 21/02

[52] U.S. Cl. ..... 51/103 WH; 51/137

[58] Field of Search ..... 51/103 R, 103 TF, 103 WH, 51/138, 137, 145, 215 E, 215 H

[56] References Cited

U.S. PATENT DOCUMENTS

| | | | |
|---|---|---|---|
| 2,110,931 | 3/1938 | Dyer | 51/215 E X |
| 2,565,016 | 8/1951 | Possi | 51/103 TF |
| 2,716,311 | 8/1955 | Berstecher | 51/103 R |
| 2,912,798 | 11/1959 | Seidel | 51/103 WH |
| 3,909,986 | 10/1975 | Miyazawa | 51/138 |

FOREIGN PATENT DOCUMENTS

| | | | |
|---|---|---|---|
| 968,437 | 7/1949 | Germany | 51/138 |

*Primary Examiner*—Harold D. Whitehead
*Assistant Examiner*—Nicholas P. Godici
*Attorney, Agent, or Firm*—Oblon, Fisher, Spivak, McClelland & Maier

[57] ABSTRACT

The invention provides an apparatus for manufacturing lengths of tubular fibrous pipe insulation, the improvement comprising the provision for an abrasive treatment apparatus comprising conveyor means operable to receive such lengths mounted on their respective forming mandrels after setting the binder and to forward said lengths on said mandrels to an abrasive treatment station, an abrading member at said station to abrade the outer surface of said lengths and a member to rotate a length, on its mandrel, in contact with said abrading member while maintaining a controlled spacing between the mandrel and the abrading member.

3 Claims, 6 Drawing Figures

Figures 1A, 1B, 1C, 1D, 1E:
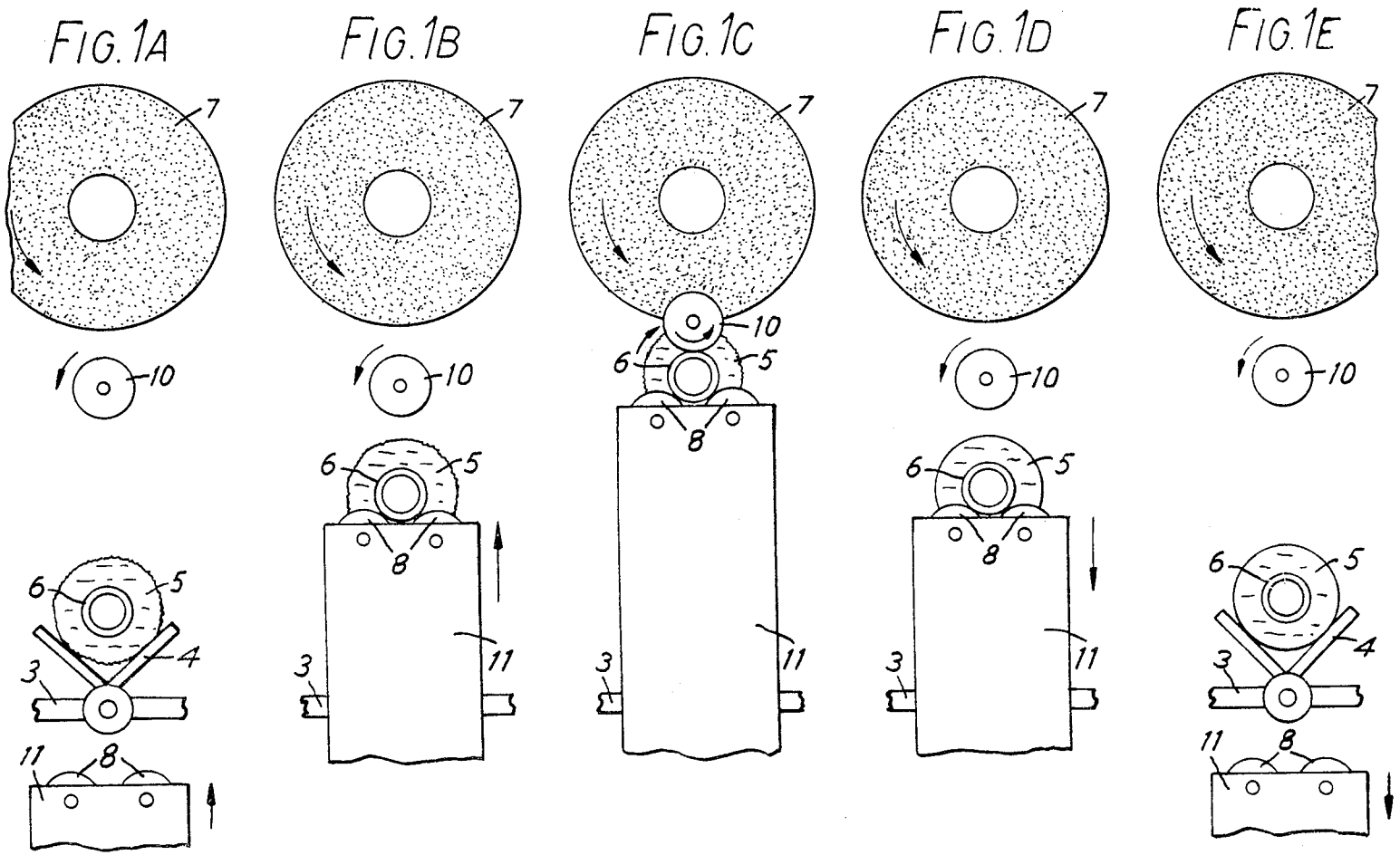

3
4
5
6
7
8
10
11

APPARATUS FOR MANUFACTURE OF INSULATION PRODUCTS

This invention relates to the manufacture of fibrous tubular pipe insulation members from mats of fibres, usually of glass or mineral wool. Such tubular pipe insulation is usually made by wrapping a length of mat around a forming mandrel whose external diameter corresponds to that of the pipe to be insulated. The mat may be either pre-treated with a settable binder, which is caused to set in situ after wrapping on the mandrel, or the material may be treated with a binder after wrapping, which is then caused to set. For many applications, a thermosetting resin binder is commonly used. Such lengths of fibrous tubular pipe insulation are known as sections and will be so described throughout this specification. For convenience, one wall of the thus formed section is slit through axially to enable it to be fitted over an existing pipe without breaking the latter at any point. For ease of handling a partial slit may also be made in the opposite wall, from the inside. Alternatively, the tube may be slit into two halves.

An apparatus for producing sections on a semi-automatic basis is known. It comprises a wrapping station where binder-impregnated lengths of mat are cut from a roll and wrapped around individual forming mandrels. These mandrels and sections are then forwarded by a conveyor through an oven wherein the binder is caused to set. After setting the binder, the sections, still on their forming mandrels are forwarded by the same or another conveyor to a station at which the mandrels are removed for return to the wrapping station.

Whilst the mandrel itself accurately defines the bore of the section, its external diameter and indeed its external surface appearance may be difficult to control because of the somewhat ragged, fibrous nature of the starting material. The external surface of a section can be shaped by using an external sleeve, preferably foraminous to facilitate setting of the binder by means hot air stream, but this approach demands not only a large stock of mandrels, but also an even larger stock of external sleeves, since the section thickness may have to be changed to meet different insulation requirements. Furthermore, the mandrel and sleeve must be kept sensibly concentric, which may present considerable handling problems in a production line process. It is also possible to smooth the outer surface of a section whilst setting the binder. For example, the section can be rotated on its mandrel whilst presenting its outer surface to a concave curved stationary surface which smoothes and compresses the surface of the fibrous mat. Unfortunately, fibrous mats can be of variable density and this smoothing technique may give a section of non-uniform wall thickness. According to the present invention we provide in an apparatus for manufacturing sections (as hereinbefore defined), the improvement comprising the provision for an abrasive treatment apparatus comprising conveyor means operable to receive sections mounted on their respective forming mandrels after setting the binder and to forward said sections on said mandrels to an abrasive treatment station, abrading means at said station to abrade the outer surface of said sections and means to rotate a section, on its mandrel, in contact with said abrading means whilst maintaining a controlled spacing between the mandrel and the abrading means.

One preferred abrading means is a grinding roller, although a finishing belt may also be used. The abrasive treatment is applied to the section whilst it is still mounted on the mandrel on which it was formed and in a conventional section manufacturing apparatus, a plurality of such forming mandrels is employed, a conveyor being used to advance these mandrels through the various stages of the manufacturing process. This conveyor may be used to present sections to the abrasive treatment station, but it is preferred that the separate conveyor means be used comprising members engageable with successive mandrels and operable to displace each mandrel in turn from the conveyor towards the abrading means and, after a section on the mandrel has been treated by the abrading means, to return it back to the conveyor.

Sections are normally shorter than their mandrels and, for example, two pairs of freely-rotatable jockey rollers may be used to lift a mandrel by its ends from the conveyor; the rollers may then be further used to present the section on the mandrel to the abrading means.

The section may be rotated about its axis whilst presented to the abrading means by simply rotating its supporting mandrel, for example, by providing a drive roller which clamps the mandrel end between the freely rotatable jockey rollers. The section itself may be rotated by means of an endless friction-surfaced belt biased against its surface. If such a belt is used, it may also be used in conjunction with a finishing belt so that the section is in effect rolled between the two belts. In this latter case, the desired controlled spacing is preferably provided by a pair of guide rails, one for each end of the mandrel and arranged to constrain the latter to follow a path spaced from the working surface of the linishing belt by the desired radius of the section.

Figure 2:
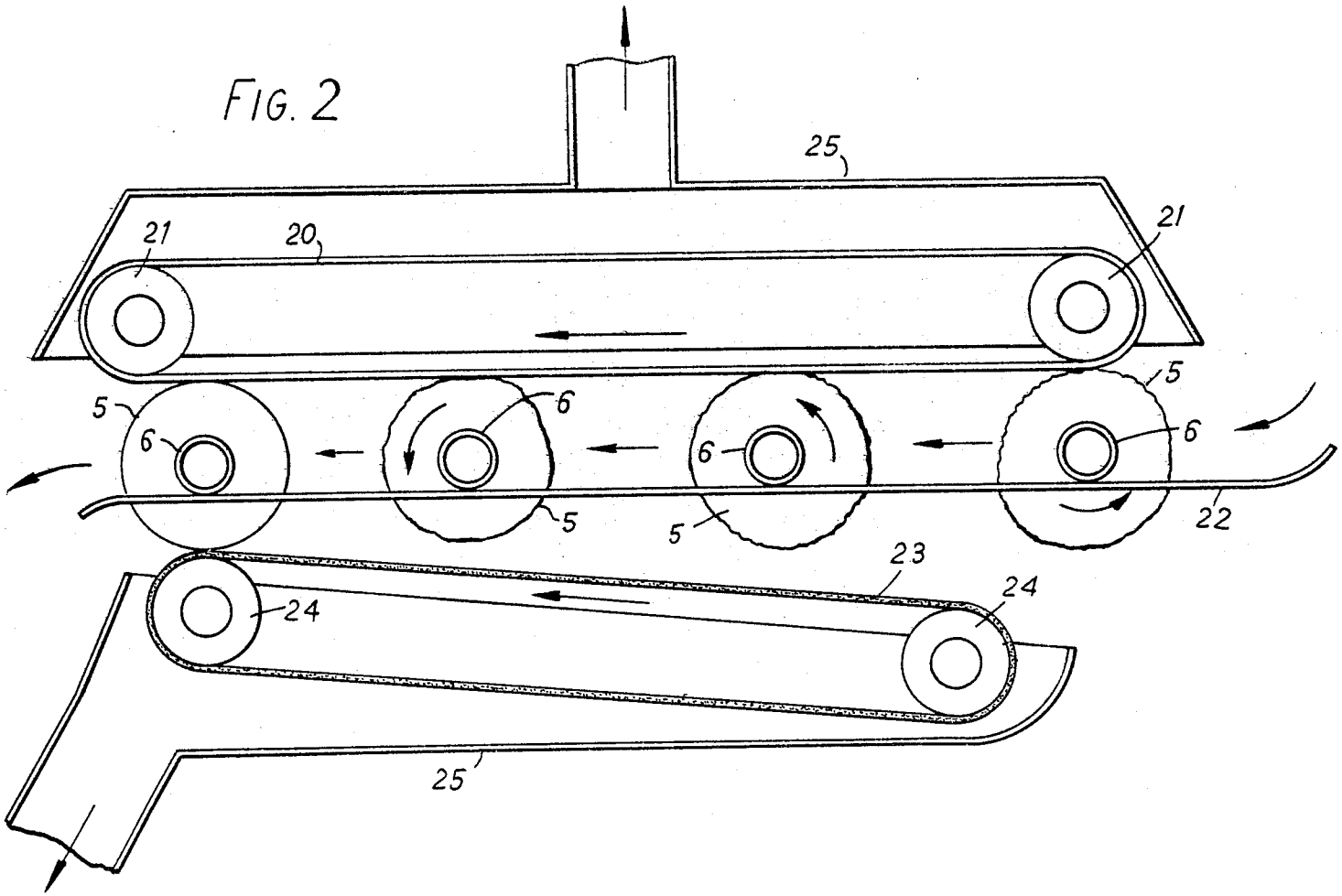

In order that the invention be better understood two preferred embodiments of it will now be described by way of example with reference to the accompanying drawings in which:

FIG. 1 is a composite, diagrammatic side view of an abrasive treatment station according to the invention and FIG. 2 is a diagrammatic side view of another abrasive treatment station according to the invention.

The figures are intended to illustrate the principle of construction rather than the mechanical details and in the interest of clarity, the latter have been omitted whenever practicable.

FIG. 1 is a composite figure in that it illustrates a number of steps in the application of an abrasive treatment to a section. Only one side of the apparatus is shown in the interests of clarity. In FIG. 1A a short length of an endless chain conveyor 3 carries a V-shaped trough 4; in the trough there is a section 5 on a mandrel 6. The section in the trough is untreated. A high speed grinding roller 7 is mounted for rotation in the direction indicated, above the trough.

Below the conveyor 3 and offset outside the plane of the conveyor 3 is a support 11, part only of which is shown also in the interests of clarity. The support carries a pair of freely rotatable jockey rollers 8.

A drive roller 10 is slidably mounted above the section 5 for movement along a line through the centre of the grinding roller 7 and the nip defined between the rollers 8, as will be explained later. The roller 10 is driven in the direction indicated.

In operation, the conveyor traverses untreated sections into the position shown in FIG. 1A. As a section arrives in the FIG. 1A position, the conveyor is stopped and the support 11 raised so that the free ends of the mandrel 6 projecting from the section 5 are engaged by the freely rotatable rollers 8, (one pair being at the opposite side of the conveyor and therefore not visible in FIG. 1.) The rollers lift the mandrel and its section vertically out of the trough as shown in FIG. 1B.

The vertical movement is halted when the mandrel end is also engaged by the drive roller 10 and the section is engaged by the grinding roller, as shown in FIG. 1C.

The drive roller rotates as indicated, in the same direction as the direction as the grinding roller, so that the mandrel and section thereon are rotated in the opposite direction. The roller 9 and 10 hold the section surface into contact with grinding roller, whilst the trough from which the section was lifted is empty, as shown. After grinding, the support is lowered to return the section progressively back into its trough, as shown in FIGS. 1D and E.

The apparatus of FIG. 2 is somewhat different in that finishing band is used to apply the abrasive treatment and an endless belt is used to rotate the sections whilst in contact with the finishing band. The apparatus comprises a friction-faced belt 20 mounted for circulation around a pair of drive rollers 21. The lower run of the belt 20 is parallel to and spaced apart from a pair of support rails 22, one of which is at the opposite side of the apparatus and therefore not seen. Below the rails 22 a finishing band 23 having the full width of the section to be treated is mounted for circulation around a pair of drive rollers 24. The latter are displaceable relative to the rails so as to facilitate setting the minimum clearance between the upper face of the band and the rails. As shown, the band is angled with respect to the rails, although it will be appreciated that the axes of the drive rollers 24 are sensibly parallel to the planes occupied by the rails and the surface of the friction faced belt above it.

The apparatus is enclosed, as far as practicable, in a dust extraction hood 25.

In operation, mandrels carrying sections are introduced at the right hand side of the apparatus shown in the figure and allowed to roll along the rails 22 until engaged by the belt 20 which then drives them along the rails and into contact with the finishing band 23. The contact is progressive and results in a progressive abrasive treatment of each section in turn. The treatment sections, still on their mandrels, roll out of the apparatus at the left hand end and proceed to further processing, such as mandrel removal and inspection and trimming to length.

I claim:

1. In an apparatus for manufacturing sections by wrapping fibrous mat around mandrels to form lengths of fibrous, tubular pipe insulation in which the fibers are thereafter bonded by setting a binder in situ in the mat prior to removal of the mandrels, the improvement comprising the provision for an abrasive treatment apparatus which comprises;

conveyor means operable to receive said sections mounted on their respective forming mandrels after setting the binder and to forward said sections on said mandrels to an abrasive treatment station;

abrading means at said station to abrade the outer surface of said sections; and, means to rotate a section, on its mandrel, in contact with said abrading means whilst maintaining a controlled spacing between the mandrel and the abrading means wherein each mandrel is longer than a section mounted thereon and has a free end portion projecting axially from each end of said section, said apparatus having transfer means comprising lifting members engageable with said free end portions and displaceable relative to the direction of travel of the conveyor means so as to lift said mandrel from the conveyor means to present a section thereon to the abrading means, the transfer means further comprising a drive means engageable with one of said free ends and operable to rotate said mandrel and section when so presented, said lifting members being thereafter displaceable to return the mandrel and treated section to the conveyor means.

2. Abrasive treatment apparatus according to claim 1 wherein the abrading means is a grinding roller.

3. Abrasive treatment apparatus according to claim 1 wherein said lifting members comprises jockey roller members and said drive means engageable with one of said free ends comprises a roller member.

* * * * *